US005857132A

United States Patent [19]

Mizuishi et al.

[11] Patent Number: 5,857,132

[45] Date of Patent: Jan. 5, 1999

[54] APPARATUS AND METHOD FOR CLEANING A TRANSFER DEVICE OF AN IMAGE FORMING APPARATUS

[75] Inventors: Haruji Mizuishi, Tokyo; Hisashi Fuzisaki, Kawasaki; Mayumi Yoshida, Tokyo; Kenji Karashima, Kawasaki; Yasushi Akiba, Chiba, all of Japan

[73] Assignee: Ricoh Company, Ltd., Tokyo, Japan

[21] Appl. No.: 935,111

[22] Filed: Sep. 29, 1997

Related U.S. Application Data

[63] Continuation of Ser. No. 536,842, Sep. 29, 1995, abandoned.

[30] Foreign Application Priority Data

Sep. 30, 1994 [JP] Japan ..... 6-236188

[51] Int. Cl.[6] ..... G03G 15/00

[52] U.S. Cl. ..... 399/66; 399/313

[58] Field of Search ..... 399/66, 313

[56] References Cited

U.S. PATENT DOCUMENTS

| | | | |
|---|---|---|---|
| 4,269,503 | 5/1981 | Nishikawa | 399/313 |
| 5,151,736 | 9/1992 | Ohzeki et al. | 399/313 |
| 5,182,604 | 1/1993 | Asai | 355/273 |
| 5,253,022 | 10/1993 | Takeuchi et al. | 355/274 |
| 5,337,127 | 8/1994 | Imaue | 355/271 |

FOREIGN PATENT DOCUMENTS

| | | |
|---|---|---|
| 3-23481 | 1/1991 | Japan . |
| 3-69978 | 3/1991 | Japan . |

*Primary Examiner*—William J. Royer

*Attorney, Agent, or Firm*—Oblon, Spivak, McClelland, Maier & Neustadt, P.C.

[57] ABSTRACT

A contact type image transferring system and method, incorporated in an image forming apparatus, for cleaning a residual toner on a transfer roller. The transfer roller is in contact with a photoconductive drum and forms a nip between the roller and the drum. A sheet of paper passes through the nip and a toner image on the drum is transferred to the sheet of paper. When the sheet of paper is not at the nip, not only a transfer voltage but also a charging voltage is applied at a same time. The polarities of the voltages applied to the charger and to the transfer roller cause the toner on the transfer roller to be removed.

36 Claims, 4 Drawing Sheets

APPARATUS AND METHOD FOR CLEANING A TRANSFER DEVICE OF AN IMAGE FORMING APPARATUS

This application is a Continuation of application Ser. No. 08/536,842, filed on Sept. 29, 1995, now abandoned.

BACKGROUND OF THE INVENTION

1. Field of the Invention

The present invention relates to an image transferring device for an image forming apparatus such as a copier, printer, facsimile transceiver or similar photographic image forming apparatus in which an image is formed on a photoconductive element. More particularly, the invention is concerned with a contact type image transferring device including, for example, a transfer roller or a transfer belt, for transferring a toner image from the photoconductive element to a sheet of paper which is passed through a nip between the photoconductive element and the image transferring device. The present invention further relates to a method and apparatus for electrically cleaning the transferring device.

2. Description of the Related Art

It is a common practice for an image forming apparatus of the kind described above to use a contact type image transferring device. The contact type device transfers a toner image from a photoconductive element to a sheet passed through a nip between the photoconductive element and the transfer device to which an electrical field opposite in polarity to the toner image is applied. Since the contact type transfer device is in direct contact with the photoconductive element when the sheet is not at the nip portion, the toner image on the surface of the photoconductive element transfers to the surface of the transfer device. As a result, the toner image on the transfer device is transferred to the back side of the sheet.

Japanese Laid-Open Patent Publication No. 3-69978 discloses a cleaning device for a transfer roller in which toner on the surface of the roller is transferred to the photoconductive element by applying cleaning bias voltage to the transfer roller when the transfer roller is in direct contact with the photoconductive element. Since there is not only regular toner having a positive polarity but also oppositely charged toner having a negative polarity, for cleaning both types of toner, the related art discloses that the polarity of a cleaning bias voltage is switched over between the positive polarity and the negative polarity.

However, since the bias voltage of a main charger and that of the developing device is turned off, regularly charged toner is transferred from the developing device to the photoconductive element at a developing area due to a potential between toner and the surface of the photoconductive element. Toner which is transferred to the photoconductive element is then transferred to the transfer roller and the roller becomes dirty.

SUMMARY OF THE INVENTION

Accordingly, one object of this invention is to provide a novel image transferring device for an image forming apparatus which can solve the aforementioned drawbacks. A further object of the present invention is to provide an image transferring device for an image forming apparatus in which the cleaning aspect for a contact type transfer device can be performed.

In order to achieve the above-mentioned objects, according to the present invention, an apparatus for transferring a toner image on an image carrier to a sheet includes a charging device which charges the image carrier, a power source which applies bias voltage to the charging device, a contact transferring device which is in contact with the image carrier when the sheet is not at a nip between the image carrier and the transferring device, a power source which applies bias voltage to the transferring device, and at least one control board which controls the power sources to apply bias voltage to the charging device and the transferring device when the transferring device is in direct contact with the image carrier.

Other objects and aspects of the present invention will become apparent herein.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

First Embodiment

Figure 1:
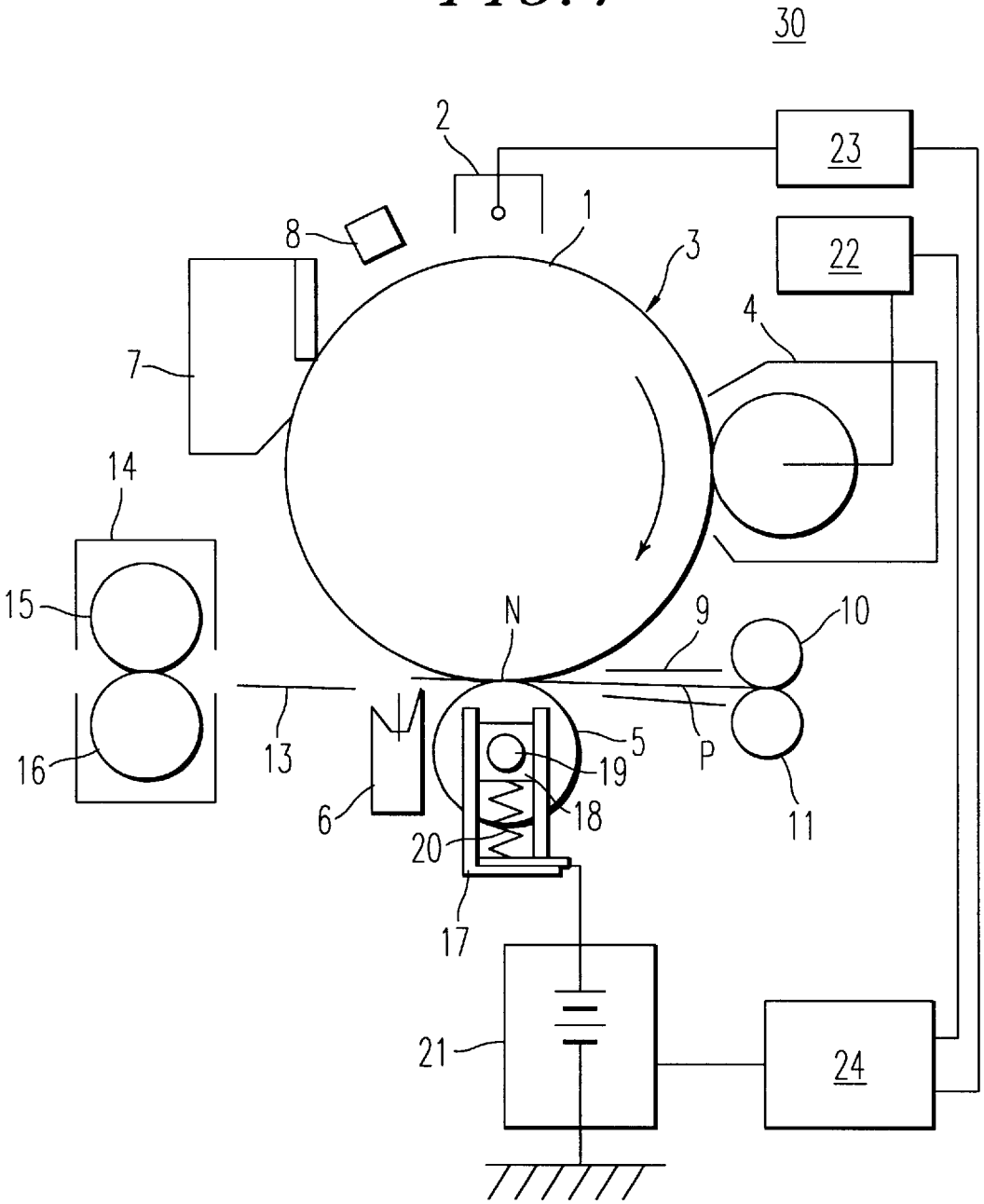
FIG. 1 is a schematic representation showing the general construction of an image forming apparatus embodying the present invention.

Referring now to the drawings, wherein like reference numerals designate identical or corresponding parts throughout the several views, and more particularly to FIG. 1 thereof, an image forming apparatus 30 embodying the present invention is shown. The image forming apparatus 30 has a rotatable photoconductive drum 1 and the following elements which may be conventional and disposed around the drum: a charging device 2 which charges the photoconductive drum 1, an exposing device 3 which forms a latent image on the photoconductive drum 1, a developing device 4 which develops the latent image and forms a toner image on the photoconductive drum 1, a transfer roller 5 which transfers the toner image to a sheet of paper, a paper separating device 6 including an electrode which separates the sheet of paper after the toner transfer operation is performed, a cleaning device 7 which cleans residual toner on the photoconductive drum 1 and a discharging lamp 8 which discharges an electric charge on the photoconductive drum 1.

The transfer roller 5 is in pressured contact with the photoconductive drum 1 and makes a nip N between the photoconductive drum 1 and the roller 5. A power source 21 which applies a transfer bias voltage to the transfer roller 5 is connected to the roller 5. A power source 22 which applies developing bias voltage to the developing device 4 is connected to the device 4. A power source 23 which applies charging bias voltage to the charging device 2 is connected to the device 2. The power sources 21, 22 and 23 are connected to a control board 24. The control board 24 applies control signals to the power sources 21, 22, and 23 in order to control the timing of the bias voltage, the output voltage value, the polarity of transfer bias voltage from the power source 21 and so on.

An electrically conductive shaft 19 of the transfer roller 5 is supported on bearings 18 which is made of an electrically conductive resin. The bearings 18 are supported on a conductive spring 20 in a frame 17 which allows the bearings 18 to move up and down. The transfer roller 5 is in pressured contact with the photoconductive drum 1 by means of the spring 20. The amount of pressure from the transfer roller 5 to the photoconductive drum 1 is less than 9.8N. In this embodiment, a diameter of the transfer roller is 16 mm. Therefore the width of the nip N is between 1.0 mm and 1.5 mm. A transfer bias voltage is applied from the power source 21 to the transfer roller 5 via the electrically conductive spring 20, the electrically conductive bearings 18 and the electrically conductive shaft 19. It is also possible to provide gap rollers (not illustrated) instead of the spring 20 to position the transfer roller 5. In this case, the gap rollers having diameters which are smaller than that of the transfer roller 5 are fixed on both sides of the shaft 19 and are in contact with a core of the photoconductive drum 1. This results in a stable pressure from the surface of the transfer roller 5 to the photoconductive drum 1.

The transfer roller 5 includes the electrically conductive shaft 19 and an electrically conductive rubber layer such as silicon rubber, urethane rubber, epichlorohydrin rubber, EPDM or combinations thereof coated on the shaft. The electrically conductive rubber layer has an electric resistance between $10^6$ Ω.cm and $10^{11}$ Ω.cm. The hardness of the rubber is less than 40° (JIS A). Since the electrical resistance of the ends of the roller 5 is smaller than the other (central) portion of the roller 5, unusual discharge from the ends of roller occurs. In order to prevent this unusual discharge, the ends of the roller 5 are tapered. The length of the roller 5 is smaller than that of the photoconductive drum 1.

In operation, the surface of the photoconductive drum 1 is negatively charged by the charging device 2. The charged surface of the drum 1 is exposed by the exposing device 3 and an electric latent image is formed thereon. The electric latent image is developed by the developing device 4 in which toner is negatively charged. The sheet of paper P is fed from a paper tray (not illustrated) to a pair of resister rollers 10 and 11. The sheet of paper P which has already reached the resister rollers 10 and 11 is fed to the nip N by the resister rollers 10 and 11 via a pair of paper guide plates 9 and the sheet of paper P is in pressured contact with the photoconductive drum 1 by the transfer roller 5 at the nip N. Since a positive bias voltage is applied from the power source 21 to the transfer roller 5, a toner image which is negatively charged is transferred from the photoconductive drum 1 to the sheet of paper P. The sheet of paper P is then discharged by a discharge electrode of the paper separating device 6 and then the sheet of paper P is separated from the photoconductive drum 1. The sheet of paper P on which the toner image is formed is then transported to a fixing device which has a heated roller 15 and a pressure roller 16 via a guide plate 13, and the toner image is fixed on the sheet. The sheet of paper P is then discharged to a paper discharge tray (not illustrated). After the transfer operation, residual toner on the surface of the photoconductive drum 1 is cleaned by the cleaning device 7, and residual electric charge on the drum 1 is discharged by the discharge lamp 8.

Figure 2:
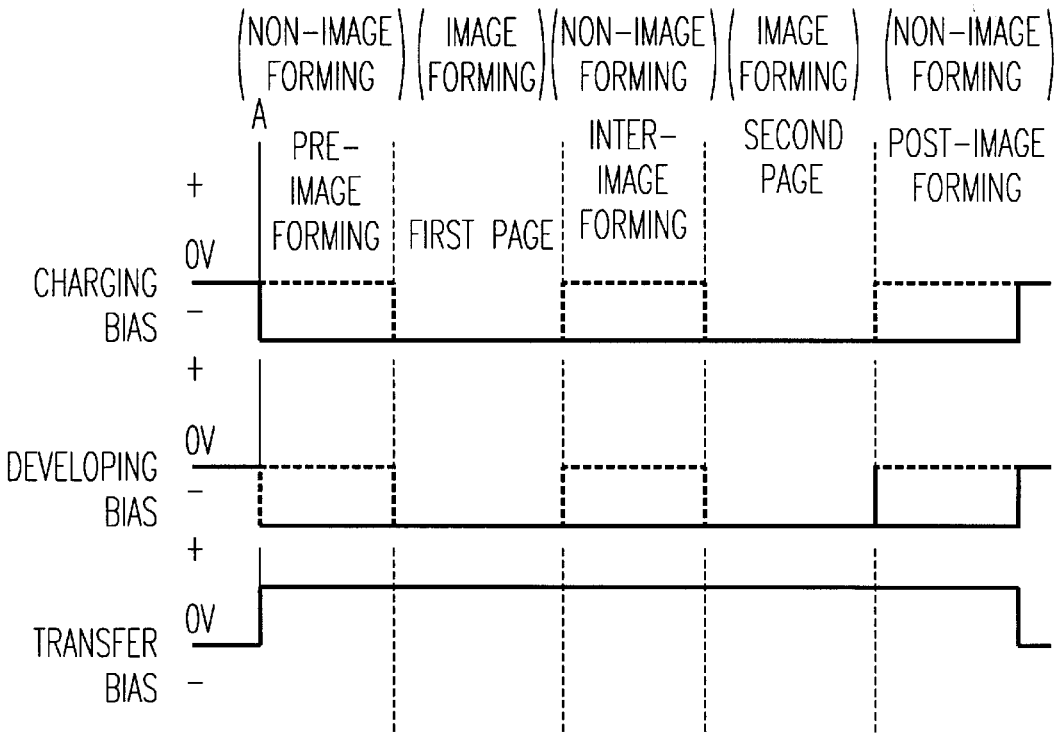
FIG. 2 is a timing diagram showing the charging, developing, and transferring biases of a device embodying the present invention.

FIG. 2 shows the timing of applying the charging bias voltage, the developing bias voltage and the transfer bias voltage of FIG. 1. In FIG. 2, the solid lines show the timing of applying the bias voltages of this embodiment and the broken lines show the timing of the bias voltages of the related art. Referring to FIGS. 1 and 2, when a print start signal is inputted at time A, the signal is inputted into the control circuit 24. Then the control circuit 24 outputs a control signal to the power sources 21, 22 and 23 to control starting and stopping of applying the bias voltage.

During a pre-image forming period of time, from the time the photoconductive drum 1 starts its rotation until the leading edge of an image area on the drum 1 reaches the nip N, the surface of the drum 1 is negatively charged. During that period of time, both the developing bias voltage and transfer bias voltage are also applied to the developing device 4 and the transfer roller 5, respectively. Since the surface of the photoconductive drum 1 is negatively charged, regularly (i.e., negatively) charged toner in the developing device 4 does not adhere to the surface of the photoconductive drum 1. Oppositely charged (positive polarity) toner, the quantity of which is much less than that of the regularly charged toner, is slightly adhered to the surface of the drum 1 due to the potential between the electric field of the toner and that of the surface of the drum 1. Since the positive bias voltage is applied to the transfer roller 5, oppositely (positively) charged toner on the surface of the drum 1 does not adhere to the transfer roller 5, even if the oppositely charged toner on the surface of the drum 1 reaches the nip N. The photoconductive drum 1 rotates further and the oppositely charged toner on the surface of the drum 1 is cleaned by the cleaning device 7.

The cleaning operation for the transfer roller 5 is also carried out during an inter-image time period (i.e., between successive copying operations), and during a post-image forming period of time, a period of time after the last image area on the drum 1 passes through the nip N. According to the present embodiment, regularly charged toner in the developing device 4 is not transferred to the surface of the photoconductive drum 1 and oppositely charged toner on the surface of the drum 1 is not transferred to the transfer roller 5 during the cleaning operation of the transfer roller 5.

Second Embodiment

Figure 4:
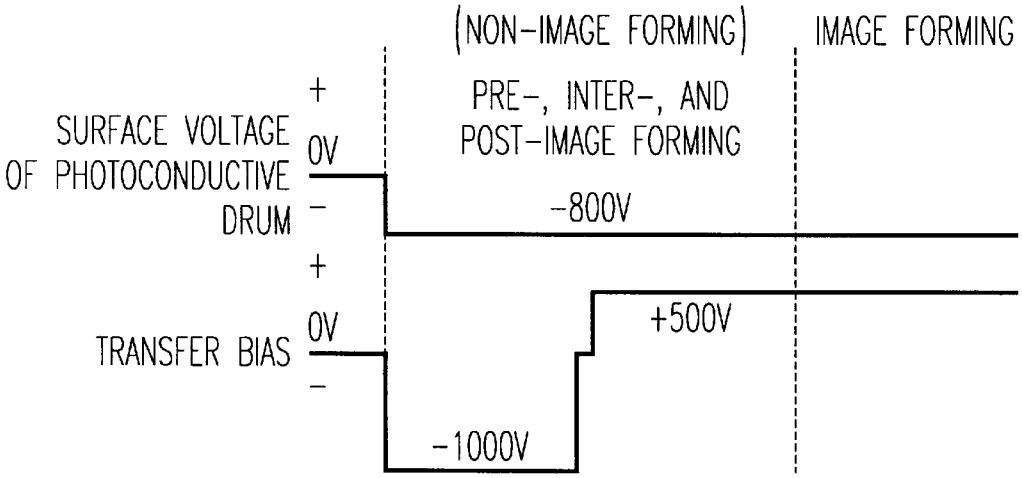
FIG. 4 is a timing diagram showing the voltages of the photoconductive drum and the transfer roller of a modified embodiment of present invention.
Figure 3:
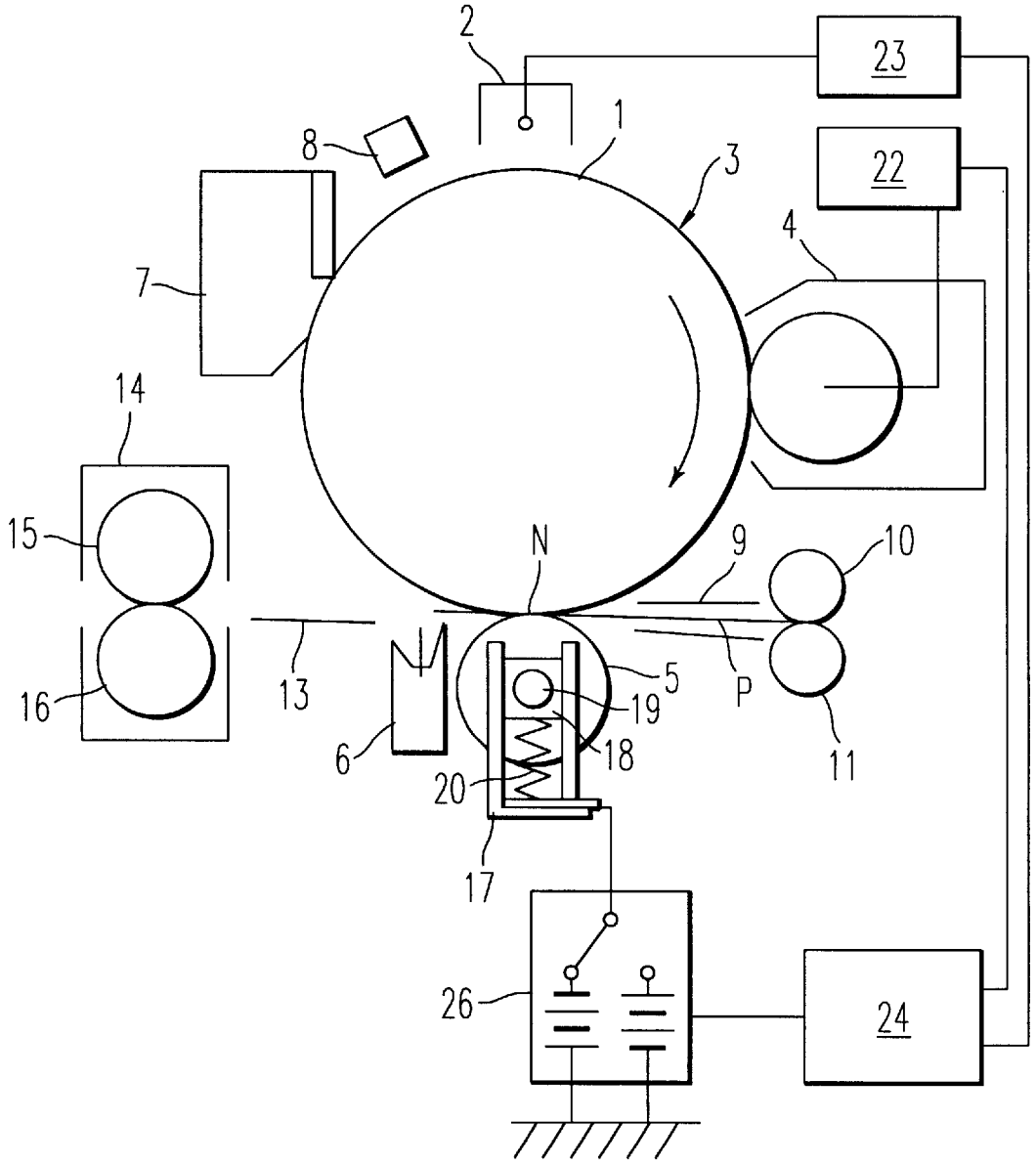
FIG. 3 is a schematic representation showing the general construction of an image forming apparatus of a modified embodiment of the present invention.

FIGS. 3 and 4 show a modified embodiment of this invention. Before discussing the modified embodiment, a background of this embodiment will be set forth. If a paper feed jam occurs at a transfer station, toner which has not yet been fixed on the sheet of paper is scattered inside the apparatus. As a result, the scattered toner adheres to the transfer roller and the roller becomes dirty. Since unfixed toner has already transferred to the sheet of paper, the toner is regularly charged toner. Therefore, it is necessary to clean the regularly charged toner adhered to the roller 5 and this embodiment performs this function. Referring to FIG. 3, the power source 26 has a switching circuit which switches the transfer bias voltage between the positive and negative polarities. The switching circuit may be constructed using an electro-mechanical switcher such as a solenoid, or a solid state switching device. Other elements of FIG. 3 respectively correspond to those of FIG. 1 and the detailed description is therefore omitted for brevity.

Referring to FIGS. 3 and 4, the transfer bias voltage is switched over from the negative polarity which is the same polarity as the regularly charged toner to the positive polarity which is the same polarity as the oppositely charged toner during the pre-, inter-, and post-image forming operations. In this embodiment, the transfer bias voltage is switched over from −1000V to +500V, and the charged voltage of the photoconductive drum 1 is −800V. Since the absolute value of the transfer bias voltage is greater than the charged voltage of the drum 1, an electric field from the surface of the transfer roller 5 toward the surface of the photoconductive drum 1 is formed. The electric field transfers regularly (negatively) charged toner which is adhered to the transfer roller 5 from the roller 5 to the drum 1 when the transfer bias voltage has a negative polarity. Then the transfer bias voltage is switched over to the positive polarity before the oppositely (positively) charged toner image on the drum 1 reaches the nip N, thereby preventing the positively charged toner on the drum 1 from transferring to the roller 5 at the nip N. The positively charged toner on the drum 1 is then cleaned by the cleaning device 7.

Third Embodiment

Figure 5:
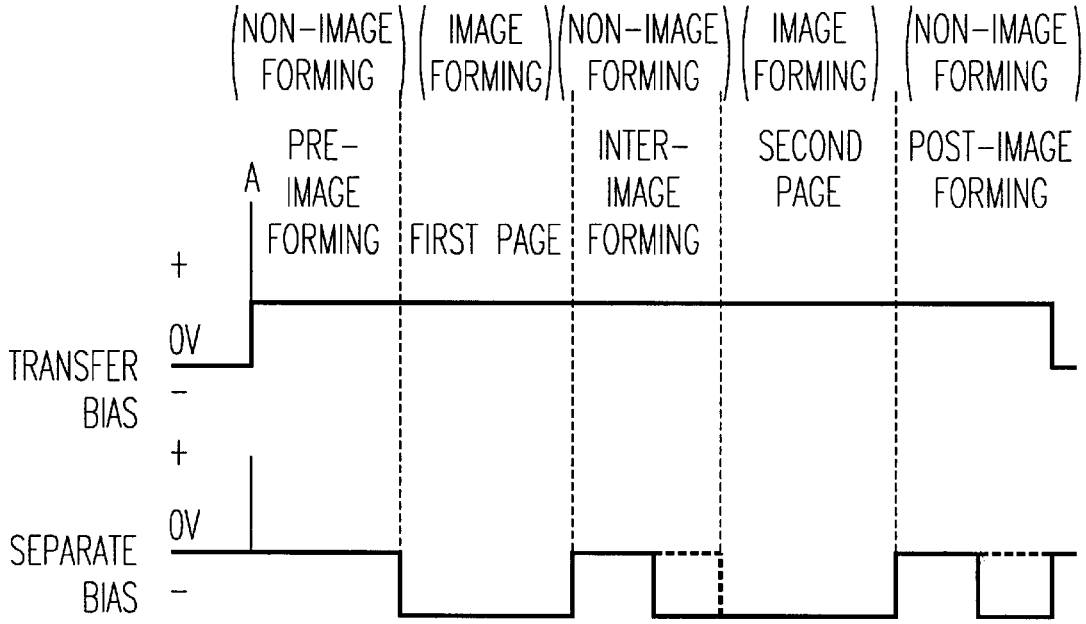
FIG. 5 is a timing diagram of applying a bias voltage to a paper separating electrode and a transfer device according to the present invention.

If a positive polarity transfer bias voltage is applied to the photoconductive drum 1 which has a sensitivity to the negative polarity, the drum 1 will occasionally be charged to the positive polarity. The charged voltage cannot be discharged by emitting light from the discharging lamp 8 and it is necessary to discharge the voltage by an AC charger or DC charger which has the opposite polarity of the charged drum 1. In this embodiment, a DC power source (not illustrated) is connected to the paper separating device 6 of FIGS. 1 or 3, which applies a negative polarity DC voltage to the discharge electrode of the device 6. Referring to FIG. 5, the DC voltage is applied to the discharge electrode not only during an image forming period of time but also during an inter- and post-image of forming period of time. According to the present embodiment, a positive separating bias is not applied.

As for another embodiment, it is also possible to apply a DC bias voltage, for example −150V, from a DC power source (not illustrated) to the electrically conductive core of the photoconductive drum 1 as a charging device. Therefore, the drum 1 is always negatively biased, for example 100V, which is the same polarity as the regularly charged toner. Since the developing bias voltage is 0V and the polarity of the drum 1 is the same polarity as the toner, the regularly charged toner is not transferred to the drum 1 during the cleaning operation of the transfer roller 5.

It is also possible to apply a positive developing bias voltage which is opposite in polarity to the regularly charged toner to attract regularly charged toner to the developing device 4 during the cleaning operation for the transfer roller 5. During this period of time, the surface voltage of the drum 1 is 0V.

It is also possible to use a charging roller or a charging brush as the charging device. Further, it is also possible to provide a single power source from which the bias voltages are applied to the charging device, the developing device and the transfer device instead of a plurality of power sources which are respectively connected to the devices.

The present invention uses control boards to perform the described function. These boards may be implemented using a conventional microprocessor or conventional general purpose digital computer programmed according to the teachings of the present application, as will be appropriate to those skilled in the art. Appropriate software coding can readily be prepared by skilled programmers based on the teachings of the present disclosure, as will be apparent to those skilled in the software art. The invention may also be implemented by the preparation of applications specific integrated circuits or by interconnecting an appropriate network of conventional component circuits, as will be readily apparent to those skilled in the art.

Obviously, numerous modification and variations of the present invention are possible in light of the above teachings. It is therefore to be understood that within the scope of the appended claims, the invention may be practiced otherwise than as specifically described herein.

What is claimed is as new and is desired to be secured by Letters Patent of the United States is:

1. An apparatus for transferring a toner image on an image carrier to a sheet, comprising:

a charging device which charges said image carrier;

a first power source which applies a charging voltage to said charging device;

a transferring device which is in direct contact with said image carrier when said sheet is not at a nip between said image carrier and said transferring device;

a second power source which applies a transferring voltage to said transferring device; and at least one control board which controls said first and second power sources so as to apply the charging voltage to said charging device and the transferring voltage to said transferring device during a time period between consecutive image forming operations during which said transferring device is in direct contact with said image carrier, said at least one control board controlling the transferring voltage to be constant over a period of time during which a first image is formed, no image is formed, and a second image is formed.

2. An apparatus as claimed in claim 1, wherein said transferring voltage has a polarity which is opposite to a polarity of said toner image.

3. An apparatus as claimed in claim 2, wherein said charging voltage has a negative polarity and said toner image has a negative polarity.

4. An apparatus as claimed in claim 2, further comprising:

a third power source which applies a developing voltage to a developing device, wherein said at least one control board turns the developing voltage on in synchronism with said first power source.

5. An apparatus according to claim 1, wherein:

the at least one control board controls said first and second power sources such that both of the charging voltage and the transferring voltage are constant over the period of time during which the first image is formed, no image is formed, and the second image is formed.

6. An apparatus according to claim 1, further comprising:

a third power source which applies power to a developer, wherein:

the at least one control board controls the third power source to apply a constant developing voltage over the period of time during which the first image is formed, no image is formed, and the second image is formed.

7. An apparatus according to claim 1, wherein:

the period of time during which no image is formed is an inter-image forming period between a forming of the first and second images.

8. An apparatus according to claim 1, wherein:

at least one of the charging voltage and transferring voltage is constant from a pre-image forming time period through said period of time during which the first image is formed, no image is formed, and the second image is formed.

9. An apparatus for transferring a toner image on an image carrier to a sheet, comprising:

a charging device which charges said image carrier;

a first power source which applies a charging voltage to said charging device;

a transferring device which is in direct contact with said image carrier when said sheet is not at a nip between said image carrier and said transferring device;

a second power source which applies a transferring voltage to said transferring device; and at least one control board which controls said first and second power sources so as to apply the charging voltage to said charging device and the transferring voltage to said transferring device when said transferring device is in direct contact with said image carrier, wherein said second power source is switched over between a negative polarity and a positive polarity, wherein said second power source is switched over from the negative polarity to the positive polarity when said sheet is not at the nip between said image carrier and said transferring device, and wherein an absolute value of the transferring voltage outputted from said second power source is greater than an absolute value of the charging voltage outputted from said first power source.

10. An apparatus for transferring a toner image on an image carrier to a sheet, comprising:

a charging device which charges said image carrier;

a first power source which applies a charging voltage to said charging device;

a transferring device which is in direct contact with said image carrier when said sheet is not at a nip between said image carrier and said transferring device;

a second power source which applies a transferring voltage to said transferring device; and at least one control board which controls said first and second power sources so as to apply the charging voltage to said charging device and the transferring voltage to said transferring device when said transferring device is in direct contact with said image carrier, wherein said transferring voltage has a polarity which is opposite to a polarity of said toner image, said apparatus further comprising:

a paper separating electrode which separates the sheet from said image carrier; and a power source which is connected to said paper separating electrode and applies a separating voltage to said paper separating electrode, wherein said at least one control board turns the separating voltage on when the sheet is not at a nip between said image carrier and said transferring device.

11. An apparatus as claimed in claim 10, wherein the separating voltage has a same polarity as said toner image.

12. An apparatus as claimed in claim 11, wherein said separating voltage is an AC voltage.

13. A method for transferring a toner image on an image carrier to a sheet, comprising the steps of:

applying a first voltage to said image carrier when said sheet is not at a nip between said image carrier and a contact transferring device; and applying a second voltage to said contact transferring device during a time period between consecutive image forming operations when the contact transferring device is in direct contact with said image carrier when said sheet is not at the nip, wherein said second voltage is constant over a period of time during which a first image is formed, no image is formed, and a second image is formed.

14. A method as claimed in claim 13, wherein said second voltage has a polarity which is opposite to a polarity of said toner image.

15. A method as claimed in claim 14, wherein said first voltage has a negative polarity and said toner image has a negative polarity.

16. A method as claimed in claim 14, further comprising the step of:

applying a third voltage to a developing device in synchronism with the step of applying said first voltage.

17. A method according to claim 13, wherein:

both of the first voltage and the second voltage are constant over the period of time during which the first image is formed, no image is formed, and the second image is formed.

18. A method according to claim 13, further comprising the step of:

applying a constant third voltage to a developing device over the period of time during which the first image is formed, no image is formed, and the second image is formed.

19. A method according to claim 13, wherein:

the period of time during which no image is formed is an inter-image forming period between a forming of the first and second images.

20. A method according to claim 13, wherein:

at least one of the first voltage and the second voltage is constant from a pre-image forming time period through said period of time during which the first image is formed, no image is formed, and the second image is formed.

21. A method for transferring a toner image on an image carrier to a sheet, comprising the steps of:

applying a first voltage to said image carrier when said sheet is not at a nip between said image carrier and a contact transferring device; and applying a second voltage to said contact transferring device which is in direct contact with said image carrier when said sheet is not at the nip, wherein said second voltage is switched over between a negative polarity and a positive polarity, wherein said second voltage is switched over from the negative polarity to the positive polarity when said sheet is not at the nip between said image carrier and said contact transferring device, and wherein an absolute value of said second voltage is greater than an absolute value of said first voltage.

22. A method for transferring a toner image on an image carrier to a sheet, comprising the steps of:

applying a first voltage to said image carrier when said sheet is not at a nip between said image carrier and a contact transferring device; and applying a second voltage to said contact transferring device which is in direct contact with said image carrier when said sheet is not at the nip, wherein said second voltage has a polarity which is opposite to a polarity of said toner image, said method further comprising the step of:

applying a separating voltage to a paper separating electrode which separates the sheet from said image carrier when said sheet is not at the nip between said image carrier and said contact transferring device.

23. A method as claimed in claim 22, wherein said separating voltage has a same polarity as said toner image.

24. A method as claimed in claim 23, wherein said separating voltage is an AC voltage.

25. An apparatus for transferring a toner image on an image carrier to a sheet, comprising:

a charging device which charges said image carrier;

a first power source which applies a charging voltage to said charging device;

a transferring device which is in direct contact with said image carrier when said sheet is not at a nip between said image carrier and said transferring device;

a second power source which applies a transferring voltage to said transferring device; and at least one control board which controls said second power source so that said second power source is switched over between a negative polarity and a positive polarity.

26. An apparatus as claimed in claim 25, wherein said second power source is switched over from the negative polarity to the positive polarity when said sheet is not at the nip between said image carrier and said transferring device.

27. An apparatus as claimed in claim 26, wherein an absolute value of the transferring voltage outputted from said second power source is greater than an absolute value of the charging voltage outputted from said first power source.

28. An apparatus for transferring a toner image on an image carrier to a sheet, comprising:

a charging device which charges said image carrier;

a first power source which applies a charging voltage to said charging device;

a transferring device which is in direct contact with said image carrier when said sheet is not at a nip between said image carrier and said transferring device;

a second power source which applies a transferring voltage to said transferring device;

at least one control board which controls said first and second power sources;

a paper separating electrode which separates the sheet from said image carrier; and a power source which is connected to said paper separating electrode and applies a separating voltage to said paper separating electrode, wherein said at least one control board turns the separating voltage on when the sheet is not at a nip between said image carrier and said transferring device.

29. An apparatus as claimed in claim 28, wherein the separating voltage has a same polarity as said toner image.

30. An apparatus as claimed in claim 29, wherein said separating voltage is an AC voltage.

31. A method for transferring a toner image on an image carrier to a sheet, comprising the steps of:

applying a first voltage to said image carrier when said sheet is not at a nip between said image carrier and a contact transferring device; and applying a second voltage to said contact transferring device which is in direct contact with said image carrier when said sheet is not at the nip, wherein said second voltage is switched over between a negative polarity and a positive polarity.

32. A method as claimed in claim 31, wherein said second voltage is switched over from the negative polarity to the positive polarity when said sheet is not at the nip between said image carrier and said contact transferring device.

33. A method as claimed in claim 32, wherein an absolute value of said second voltage is greater than an absolute value of said first voltage.

34. A method for transferring a toner image on an image carrier to a sheet, comprising the steps of:

applying a first voltage to said image carrier when said sheet is not at a nip between said image carrier and a contact transferring device;

applying a second voltage to said contact transferring device which is in direct contact with said image carrier when said sheet is not at the nip; and applying a separating voltage to a paper separating electrode which separates the sheet from said image carrier when said sheet is not at the nip between said image carrier and said contact transferring device.

35. A method as claimed in claim 34, wherein said separating voltage has a same polarity as said toner image.

36. A method as claimed in claim 35, wherein said separating voltage is an AC voltage.

* * * * *